US006024770A

United States Patent [19]

de Lathauwer

[11] Patent Number: 6,024,770

[45] **Date of Patent: *Feb. 15, 2000**

[54] PROCESS TO IMPROVE RESISTANCE TO STAINS ON YARNS AND DERIVED PRODUCTS

[75] Inventor: Armand de Lathauwer, Aalst, Belgium

[73] Assignee: N.V. Denderland-Martin, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,673

[22] PCT Filed: Sep. 28, 1994

[86] PCT No.: PCT/BE94/00062

§ 371 Date: Mar. 29, 1996

§ 102(e) Date: Mar. 29, 1996

[87] PCT Pub. No.: WO95/09266

PCT Pub. Date: Apr. 6, 1995

[30] Foreign Application Priority Data

Sep. 30, 1993 [BE] Belgium ..... 9301025

[51] Int. Cl.[7] ..... D06P 1/653

[52] U.S. Cl. ..... 8/595; 8/137; 8/542; 8/929; 8/930; 8/924

[58] Field of Search ..... 8/924, 137, 595, 8/596, 542, 929, 930, 102

[56] References Cited

U.S. PATENT DOCUMENTS

| | | | |
|---|---|---|---|
| 2,480,775 | 8/1949 | Ryan . | |
| 3,669,611 | 6/1972 | Shimauchi et al. | 8/595 |
| 3,961,881 | 6/1976 | Sumner et al. . | |
| 3,999,940 | 12/1976 | Freeman | 8/595 |
| 5,571,551 | 11/1996 | Fusi et al. | 426/540 |
| 5,639,500 | 6/1997 | Fusi et al. | 426/540 |
| 5,681,604 | 10/1997 | Li et al. . | |

FOREIGN PATENT DOCUMENTS

| | | |
|---|---|---|
| 0 261 637 | 3/1988 | European Pat. Off. . |
| 58 -154772 | 9/1983 | Japan . |
| 62-238887 | 4/1986 | Japan . |
| 61-174485 | 8/1986 | Japan . |
| 1254541 | 11/1971 | United Kingdom . |

OTHER PUBLICATIONS

*Dyeing and Chemical Technology of Testile Fibres,* 6th Edition, E.R. Trotman 1984 p. 474–478, 480, 1984.

C. C. Cook et al., "The Effect of Some Aromatic Hydroxy Compounds on the Adsorption of Anionic Dyes by Nylon 6", Textile Res J. 47, 244 (1977) pp. 244–249, 1977.

Chemical Abstracts vol. 97 (1982) abstract 7704u, (Kane–) Kanebo et al, Studies on the mechanism of dye fixation. Part 10. Effect of aftertreatment with tannic acid on the fixation of disperse, acid, direct and basic dyes, Ogasawara, et al.

*Primary Examiner*—Margaret Einsmann
*Attorney, Agent, or Firm*—Hall, Priddy & Myers

[57] ABSTRACT

The invention consists of a process to improve the resistance to stains on yarns, on the basis of wool, silk, polyamide, polyacrilonitrile, natural and artificial cellulosic fibres and in general, all other synthetical fibres which can be dyed. According to the invention the yarns are treated during the dyeing process with an aqueous solution containing up to 5% tannic acid in acid medium. It is economically advisable to add a stabiliser to the solution to avoid oxidation of the solution and the fibres, and possibly a wetting agent. Preferably the treatment is made during the dyeing procedure, before, during or after the effective dyeing step.

18 Claims, No Drawings

PROCESS TO IMPROVE RESISTANCE TO STAINS ON YARNS AND DERIVED PRODUCTS

This invention relates to a process to improve the resistance to stains on yarns on the basis of silk, wool, polyamide, polyester, polyacrylonitrile, natural and artificial cellulosic fibres and in general all other synthetic fibres which can be dyed, by which the resistance of the dyed fibres against stains, especially coloured stains, is increased, whilst at the same time also other improved characteristics are obtained.

By "yarns" has to be understood, yarns whether greige (raw) or processed, yarns unfinished or finished, bright as well as dull, in yarn form or processed to fabric, felt, knitwear, non-woven, carpets, rugs, etc. To simplify matters, in this description yarn in which form whatsoever will be called "substrate".

Removal of stains, coloured or not, from a substrate, is still a very delicate problem, as there could remain traces or spots either by discoloration or coloration of the original substrate caused by the stain or by the detergents which affect the dyestuff of the substrate. This is especially the case for stains caused by products containing persistant dyestuffs or pigments for instance present in coffee, tea, wine, fruit juices, inks. . .

The purpose of this invention is to propose a process by which the resistance of a coloured or uncoloured substrate against stains of any nature is considerably improved and which at the same time improves the antistatic behaviour, as well as the resistance to soiling, house-mite and oxidative bleaching agents.

It is known (C.A. Vol. 97 (1982) 7.704 U) that tannin is used to fix dyestuff after the dyeing process. On the other hand it is also known from the swimwear industry, to treat coloured nylon fabric with extractions of gallotannin to improve the colour fastness to chlorine. This was based on the fact that the additional treatment of coloured nylon fabric with gallotannin extractions caused a migration of the dyes in the fibre whereby the gallotannin is fixed on the fibre. This provides a certain resistance to discoloration of the substrate by products containing chlorine. However this treatment has no known effect on coloured stains, and is not at all effective. for stains caused by other oxidative bleaching agents.

During extensive research in this field, it has now surprisingly been demonstrated that the resistance of coloured or uncoloured substrate to stains is considerably improved when the substrate is treated during the dyeing process with an aqueous solution containing up to 5% tannic acid by a pH lower than 6.

The term "dyeing process" as used in this description and claims is to be understood in a broad sense and means any or more steps in the sequence of steps applied to a substrate to give this substrate its coloured and finishing characteristics, whereby this sequence of steps can be done in one or more treatments.

It has been found that this treatment is very effective against stains caused by dyes of natural or synthetic origin with anionic, cationic, metalcomplex or disperse nature.

That the tannic acid would improve the discoloration caused by chlorine, could be expected by the man skilled in the art, but that this treatment would be efficient against coloured stains, could not be predicted.

According to the invention, the substrate, in acid medium, is treated with a solution containing 5 to 50 gram tannic acid per litre water and preferably between 25 to 35 g/l.

These concentrations and proportions are not critical, though it has been noticed that higher concentrations hardly influence the result but could cause a yellowing of the substrate.

Tannic acid is a compound derived for several centuries from nutgalls and has a structure of polygalloylglucose or polygalloylquinic acid.

The term "tannic acid" as used in this description and claims should be understood in a broad sense, and covers products containing tannic acid, such as for instance gallotannin.

In fact tannic acid is a mixture of compounds consisting of a glucose-chain which is several times substituted with gallic acid or trihydroxy-3,4,5-benzoic-acid-1. Substitution can also be made with digallic acid or with trigallic acid.

Tannic acid e.g. contains nonagalloylglucose, a glucose-chain substituted 5 times with gallic acid, 4 times of which is digallic acid and the formula of which is the following:

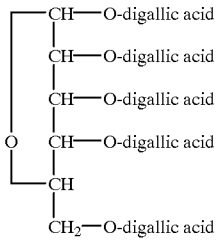

According to the invention, any commercial tannic acid can be used, though it is economical to use a tannic acid with a relatively high molecular weight. The molecular weight of the tannic acid will preferably be between 900 and 3500, though this range is not critical.

Surprisingly it has also been found that optimum results are achieved when a mixture of a tannic acid with a relatively low MW and a tannic acid with a relatively high MW is used. So it has been shown that a mixture, consisting of a tannic acid with an average MW lower than 1000 and a tannic acid with an average MW higher than 1500, gives better results than tannic acid of exclusively 1500 MW.

The tannic acid is used in an aqueous solution. For the man skilled in the art, it will be clear that the water has to be de-ironed and softened. To avoid oxidation of the solution, a small quantity of an aliphatic carboxylic acid with a boiling-point lower than 100° C., e.g. acetic acid, can be added.

To avoid oxidation of the substrate, for instance during and after the fixation of the dye, it is also recommended to add a non volatile, non hygroscopic and preferably non corroding acid, as e.g. an aliphatic carboxylic acid such as citric acid or polyacrylic acids. It could also be economical to add a wetting agent, such as e.g. isopropanol.

According to an advantageous embodiment of the invention it is recommended to add a complexing agent to the solution, for instance a polyvalent salt, which can neutralise the free OH groups from the tannic acid. Potassium antimonyl tartrate or alum (aluminium potassium sulphate) can be used for this purpose in a concentration relating to the tannic acid concentration varying between 2/1 to 1/2.

The complexing agent shall preferably be dissolved in water at the ambient temperature and to this solution a non volatile acid, which does not evaporate during steaming of the substrate, can be added. Aliphatic carboxylic acids can be used in a concentration varying between 1 to 10 g per litre water. The solution with complexing agent is added to the tannic acid solution and the mixture should have preferably a pH between 2.5 and 5. If not the pH must possibly be adjusted by adding an acid for instance a sulfamic acid, formic acid, acetic acid . . . Strong mineral acids have to be avoided.

According to a preferred embodiment of the invention the substrate shall be treated with the tannic acid solution during the dyeing step and can be inserted in a continuous procedure as well as in a discontinuous procedure, and the treatment can be made before, during or after the effective dyeing step.

It is also possible to apply the treatment during a later operation. The dry and dyed substrate can then be treated during a finishing step or in a separate step. It is clear that treatment in a separate step requires an additional operation and is not recommended as a preferred embodiment. In fact such additional step can be useful when basic dyes are used as described hereafter. Nevertheless, treatment with an additional step falls within the scope of the invention.

According to the invention the substrate will be impregnated or saturated with the solution of tannic acid.

The expression "dyeing" is used in this description for any process by which dyes are applied on a substrate, such as dyeing, printing, spacing, spraying, etc. . . in a single or in multiple steps.

The dyes to be applied are dissolved in water, possibly by heating, and afterwards adjusted to the right volume with cold water. The operation will preferably be done in an acid medium.

When applying the dyestuff in a continuous printing process, an acid-resisting thickening agent, such as a hydrocolloid, e.g. Xanthanegum, will be added.

Dyestuffs suitable to be applied according to the invention, are in general acid, metalcomplex as well as disperse dyes. Basic dyestuffs are also suitable, however when using them it is recommended to apply the treatment according to the invention, as an additional treatment.

Also in a differential dyeing or cross dyeing process, when acid and basic dyes are used, it will be recommended to apply the treatment as an additional operation after dyeing.

For the man skilled in the art, it is obvious to select dyestuffs which fit in the described process and do not cause any side-reactions with the applied reagentia and products. Thus when a complexing agent is used, one shall select dyes which are not affected by such agent.

A good pre-selection of dyestuffs will be made through obvious criteria. It can e.g. be useful to select dyestuffs with fast fixing properties.

Below, some dyestuffs that fit in very well in the frame of the invention, are mentioned as non restrictive examples. The dyestuffs are indicated with their corresponding colour index number as it is common practice.

Acid Yellow 121, 219 and 230.

Acid Orange 116 and 156.

Acid Red 42, 243, 299 and 395.

Acid Blue 40, 113, 129 and 344.

Acid Black 172.

Basic Red 23 and 73.

Basic Yellow 45 and 63.

Basic Blue 45 and 129.

Mordant Orange 6.

Disperse Yellow 2.

Disperse Red 55.1 and 340.

Disperse Blue 7.

Other dyestuffs have also been tested with satisfactory results.

In case of a continuous process, the substrate, after treatment and dyeing, is steamed during a half to a few minutes with airfree saturated steam. After steaming, the coloured substrate is rinsed, preferably with water, at which a stabiliser can be added, preferably a non volatile, non hygroscopic, and non corroding acid, e.g. an aliphatic carboxylic acid, in a concentration e.g. between 0.5 to 5 g/l.

When the treatment solution contains a complexing agent the rinsing will preferably be done with hot water (60°–90° C.), without complexing agent, the rinsing water will be cold water.

In a discontinuous process the tannic acid solution can be added to the dyebath or the treatment can be done in a separate bath.

When a substrate is treated according to one of these embodiments, an unknown resistance to colour stains of natural or synthetic origin containing anionic, cationic, metalcomplex or disperse dyestuffs, is achieved.

Stains of coffee at 70° C., kool-aid (highly coloured soft-drink), wine, ink, etc., can easily be removed by wetting the stain with cold or lukewarm water, and dry dabbing.

Tests have been executed with respect to light-fastness, washing-fastness, etc. . . and showed that the process has no negative influence on the above mentioned fastness properties.

The process and the various ways of applying it is described more in detail below, by way of following non restrictive examples, whereby examples 1 to 5 deal with a treatment during a continuous process, examples 6 to 8 with a treatment during a discontinuous process and examples 9 and 10 relate to an additional treatment.

EXAMPLE 1

A solution is prepared by dissolving 25 g tannic acid with a MW of 2500 (Mijimoto commercial product) in 1 l of soft water. Then 2 g of a mixture of polyacrylic acids (Eulysine S BASF) and 5 ml acetic acid 80% is added as stabiliser, as well as 5 ml isopropanol as wetting agent. The pH of the solution is 2.5.

A piece of substrate (A) polyamide 6.6 is soaked in this solution at room temperature and squeezed till an uptake equal to 100% substrate.

The wet substrate is printed over with Acid Yellow 230. To this end 1 g of dyestuff is dissolved in 0.1 l of warm water, then cold water is added to 1 l. To this solution, 5 ml acetic acid 80% is added, until a pH of 3.5 is obtained. Finally, Xanthanegum Type Kelzan is added until the required viscosity is reached.

When the substrate is printed, it is steamed with airfree saturated steam at 98° C. during 2 minutes, and then rinsed with cold water. To the rinsing water and/or the last rinsing bath, 2 g of polyacrylic acids (Eulysine S) per litre of water is added. Then the substrate is dried at 100° C.

Comparative Trial Regarding Example 1

A piece of substrate (B) from the same material as substrate (A) is dyed with the same dye solution after it has been moistened with an aqueous solution of acetic acid to which isopropanol was added, but without tannic acid. The coloured substrate was steamed and rinsed in the same way as in example 1, except that the rinsing water did not contain polyacrylic acids.

Substrates A and B Were Subjected to Following Tests:

Test 1: Coffee Test

A cylinder ϕ4 cm and 40 cm high was placed on the substrate. At the bottom of the cylinder, 10 ml of hot coffee at 70° C. was injected, whilst on top of the cylinder a weight of 300 g was dropped to press the coffee into the substrate.

The coffee stain was dabbed with hot water (60° C.) and dried up with an absorbing tissue. This test was done immediately after applying the stain, on a stain left untouched during two hours and on a stain left untouched during twenty-four hours.

The stain on substrate A disappeared in the three circumstances.

On substrate B, the stain remained visible for about 20% when immediately dabbed with water, but remained for 60% after two hours and for 80% after twenty-four hours. A further treatment with household bleaching water containing 1 g/l active chlorine was needed to remove the stain. The chlorinated water left a visible pale stain.

Test 2: Red Wine Test

With the same testing material as for the test mentioned above, 10 ml of red wine was brought on the substrate and was treated with lukewarm water and dabbed dry, immediately after applying, after two hours and after twenty-four hours.

The results were similar to these of the coffee test.

On substrate A, the stain was practically completely removed in the three cases. Treatment with bleaching water containing 0.2 g/l active chlorine could remove the slightly remaining part without effect on the original aspect of the substrate.

On substrate B, the stain was only removed for respectively 40%, 30% and 20% and a further treatment with chlorinated water containing 2 g active chlorine was needed, which left a clearly visible pale stain.

Test 3: Chlorine Test

With a pipette, 2 ml of a solution of respectively 1 g/l, 3 g/l and 10 g/l active chlorine was brought on the substrate. After 24 hours the stains were visually evaluated.

On substrate A, no discoloration was noticed for 1 g/l and 3 g/l. The solution of 10 g/l had caused a slight discoloration.

On substrate B, there was already a slight discoloration at 1 g/l and a strong discoloration was noticed at 3 g/l. With 10 g/l there was a complete discoloration and the substrate was affected.

This test proved that the treatment according to the invention not only protects the colour of the substrate against chlorine, but also gives a protection against the destruction of the substrate itself.

Higher concentrations of chlorine were not tested.

Test 4: Repeated Stains

The coffee test (test 1) was repeated several times on the same spot of the substrate, and each time, the stain was treated with lukewarm water.

On substrate A, the coffee stain disappeared after three times (repeated stains) without leaving any trace. When the stain was made on the same spot for the fourth time, there was a slight discoloration visible after treatment with lukewarm water (85% of the stain could be removed).

Test 5: Light Fastness

A part of substrate A was exposed to light according to the DIN norm 54004, corresponding to ISO norm 105/BO2 (Xenontest).

The stain resistance test (test 1) as described above, was done on the exposed part after 24 hours of exposure to light, after 48 hours, after 72 hours . . . till after 240 hours of exposure.

The effectiveness of the stain removing treatment was compared with a non exposed part of substrate A. There was no difference noticed between the non exposed and the part exposed to light, even after 240 hours of exposure.

The same test was repeated on substrates A and B and the colour fastness of both substrates was compared after 240 hours of exposure. No colour difference was noticed. Therefore it can be stated that the treatment according to the invention has no negative influence on the colour fastness.

Test 6: Shampoo Test

A part of substrate A was treated with a neutral carpet shampoo (Belgian Norm NBB: G62-014). The shampoo was mixed with water and the foam brought on the substrate with a brush. The shampoo was left to dry on the carpet and then removed with a vacuum cleaner.

After this treatment, test 1 as described above was done on the cleaned part and compared to a part of substrate A not treated with shampoo. No substantial difference was noticed. This shampoo treatment and coffee test was repeated three times and showed that shampoo treatment did not affect the effectiveness of the stain-removing treatment.

EXAMPLE 2

All steps of example 1 are repeated, but instead of using 25 g tannic acid with a MW of 2500, a mixture of 12.5 g tannic acid with a MW of 900 and 12.5 g tannic acid with a MW of 2500 is used.

Substrate (C) was treated with this solution.

EXAMPLE 3

A solution is prepared by dissolving 30 g tannic acid with a MW of 2500 in 1 l of cold soft water. Then 5 ml acetic acid 80% is added as stabiliser and 10 ml isopropanol as wetting agent.

A second solution is prepared by dissolving 25 g potassium aluminium sulphate in 1 l of cold soft water. Then 2 g of a mixture of polyacrylic acids (Eulysine S) is added.

Both solutions are mixed together and the pH is adjusted to 2.5 by adding additional polyacrylic acids.

A piece of substrate (D) polyamide 6.6 is soaked in this solution at room temperature and squeezed till an uptake equal 100% to the substrate.

A solution of Acid Blue 129 is prepared by dissolving 1 g of dyestuff in 0.1 l hot water and then adding cold water up to 1 l. To this solution 5 ml acetic acid is added.

The wet substrate is impregnated with the dye solution, then steamed with airfree saturated steam at 98° C. during 2.5 minutes, and then rinsed with hot water at 80° C. containing 0.5 g/l of a mixture of polyacrylic acids. The pH after rinsing is 6.7. The substrate is then dried at 100° C.

EXAMPLE 4

The tannic acid solution as in example 2 and the dye solution as in example 3 are mixed together.

Substrate (E) polyamide 6.6 is impregnated with this mixture and then steamed, rinsed and dried as in example 1.

EXAMPLE 5

Substrate (F) polyamide 6.6 is dyed with the dye solution prepared as in example 3, and steamed and rinsed as in example 1.

The substrate is then squeezed out until a wetness content of about 35%.

The substrate is consequently impregnated with a mixture of tannic acid and complexing agent prepared as in example 3.

Afterwards the substrate is steamed during 30 seconds with airfree saturated steam and dried.

EXAMPLE 6

A substrate (G) polyamide 6.6 with a weight of 840 kg is introduced in a dye beck with winch filled with 20000 l cold soft water (pH=8.2). The winch is rotated during about 10 minutes to wet the substrate.

A mixture of 6.7 kg tannic acid with a MW of 900 and 6.7 kg tannic acid with a MW of 2500 is dissolved in warm water and added to the bath; and dyestuff dissolved in warm water is also added to the bath.

After about 10 minutes rotation of the winch the pH is adjusted to about 6 by addition of acetic acid 80%.

The bath is then progressively heated in such a way that the temperature raises about 1° C. per minute until about 90° C. This temperature is maintained during about 45 minutes. Then the pH of the bath is lowered to a pH of about 4.5 by addition of citric acid, and the winch is rotated for about 15 minutes. The bath is then cooled, the substrate is rinsed, taken out from the dye beck and dried.

EXAMPLE 7

A substrate (H) polyamide 6.6 is wetted as in example 6. A dyestuff solution is added to the bath, the pH is adjusted to about 5, and the substrate is dyed by progressive heating as in example 6.

After dyeing during the cooling of the bath at about 75° C. a solution of tannic acid prepared as in example 6 is added and the pH is adjusted if necessary by the addition of citric acid until pH=4. The bath is maintained during about 20 minutes at the temperature of 75° C. and then cooled. The substrate is consequently rinsed and dried.

EXAMPLE 8

A substrate (K) polyamide 6.6 is wetted and dyed as in example 7 and then rinsed.

The bath is renewed and in a fresh bath a tannic acid solution of composition as in example 6 is added. The pH is adjusted with formic acid until pH=4. The bath is then heated to about 75° C., kept at this temperature during about 20 minutes and then cooled. The substrate is consequently rinsed and dried.

EXAMPLE 9

A substrate (L) polyamide 6.6 is treated as in example 5, except that after the dyeing step and the rinsing step the substrate is dried.

In a later step the substrate is further treated with a mixture of tannic acid and complexing agent as in example 5.

EXAMPLE 10

A substrate (M) polyamide 6.6 is wetted and dyed as in example 6, with a combination of Acid Red 42 and Acid Blue 45 dissolved in warm water (without addition of tannic acid) and the substrate is rinsed and dried.

The substrate is introduced in a fresh bath, containing 2% of a tannic acid with a MW of 900 and the pH is adjusted with formic acid until pH=4. The bath is then heated to about 65° C., kept at this temperature during about 20 minutes and then cooled. The substrate is consequently rinsed and dried.

It is to be noted that due to the cationic dye, it is recommended to use a lower concentration of tannic acid and to lower the temperature of the bath to about 65° C. during the application of the tannic acid.

The coffee test, red wine test and chlorine test as given for example 1 are repeated on each of the substrates C to M and the results are given in table 1 hereafter.

TABLE 1

| | Coffee test | | | Red wine test | | | | |
|---|---|---|---|---|---|---|---|---|
| Substrate | 1a | 1b | 1c | 2a | 2b | 2c | 2d | 2e |
| A | 100 | 96 | 94 | 95 | 95 | 95 | 0.2 | none |
| C | 100 | 100 | 96 | 95 | 95 | 95 | 0.2 | none |
| D | 100 | 100 | 98 | 95 | 95 | 95 | 0.2 | none |
| E | 100 | 100 | 98 | 95 | 95 | 95 | 0.2 | none |
| F | 100 | 100 | 100 | 95 | 95 | 95 | 0.2 | none |
| G | 100 | 98 | 95 | 95 | 95 | 95 | 0.2 | none |
| H | 100 | 100 | 100 | 95 | 95 | 95 | 0.2 | none |
| K | 100 | 100 | 100 | 95 | 95 | 95 | 0.2 | none |
| L | 100 | 100 | 100 | 95 | 95 | 95 | 0.2 | none |
| M | 100 | 100 | 100 | 95 | 95 | 95 | 0.2 | none |
| B | 80 | 40 | 20 | 40 | 30 | 20 | 2 | discoloration |

1. Coffee test: % of stain disappeared after dabbing with hot water.

1.a stain removed immediately after applying.

1.b stain maintained during 2 hours before removal 1.c stain maintained during 24 hours before removal.

2. Red wine test: % of stain disappeared after dabbing with hot water.

2.a stain removed immediately after applying.

2.b stain maintained during 2 hours before removal.

2.c stain maintained during 24 hours before removal.

2.d concentration of active chlorine (g/l) needed to remove remaining part of stain 2.e effect on original aspect of substrate.

It is obvious that the invention is not restricted to the described examples, but applies for any process by which a substrate is treated with a tannic acid solution, whereby tannic acid is to be understood in a broad sense, as described hereabove.

Additionally to the described tests, laboratory trials were made with coloured stains originating from different types of drinks and all results showed improved resistance.

Furthermore tests were made with a tannic acid from other suppliers and did not show any difference, so that any available commercial product can be used. The molecular weight however is an important factor, and it is recommended, for economical purposes, to use a mixture of tannic acid with a low MW, and a tannic acid with a high MW. The proportion of both tannic acids is not at all critical, since good results have also been achieved with one type of tannic acid.

It is clear that tannic acid can be combined with other compounds used in the textile industry to seek for additional properties.

The examples were intentionally given with use of an identical substrate so that results could be better compared. As far as the substrate is concerned, polyamide 6.6 was used in the described examples. Other tests with other types of polyamide such as P.A.6 were also made and have given rise to similar results. Tests were furthermore made using wool, cotton, cellulosic artificial fibres, and various other kinds of fibres, and showed that the treatment can be applied on a large variety of substrates.

The concentrations, temperatures and reaction times were determined by the man skilled in the art, according to the used reagentia, products, dyestuffs, production process, type of substrate, etc. . .

To keep matters simple and in order not to complicate the comparison between the various examples, a mixture of polyacrylic acids was generally used as non volatile acid. It is clear that also the non volatile aliphatic acids can be used.

The same remark stands for the use of acetic acid, that can be replaced by another aliphatic acid with boiling-point under 100° C., and for the use of a wetting agent. Besides isopropanol, any wetting agent can be applied, provided it does not cause any undesired reaction with tannic acid or the other products used.

I claim:

1. Method for producing a stain resistant substrate with the aid of a stain resistance improving agent, said method comprising:

(A) providing a substrate containing polyamide fiber, (B) contacting said substrate with an acidic aqueous solution having a pH of up to about 6 and containing a tannic acid stain resistance improving agent in a concentration of 5 to 50 g/l, (C) bringing about such contact between said substrate and said at least one tannic acid prior to, during or after application of dye to the substrate, (D) the dyeing of said substrate taking place or having taken place at a temperature up to about 90° C., (E) drying the substrate with said tannic acid stain resistance improving agent thereon, and (F) recovering a dried, permanently dyed polyamide fiber-containing substrate wherein (1) the tannic acid stain resistance improving agent consists of at least one tannic acid, and (2) the polyamide fiber-containing substrate thus recovered is resistant to stains caused by any of the members of the group consisting of anionic dye, cationic dye, disperse dye and metallocomplex dye, and also by oxidative bleaching agent.

2. Method according to claim 1 wherein the substrate is in the form of carpet.

3. Method according to claim 1 wherein the acidic aqueous solution has a pH of up to about 5.

4. Method according to claim 1 or 2 wherein said at least one tannic acid is a mixture of tannic acid with a molecular weight lower than 1000 and tannic acid with a molecular weight higher than 1500.

5. Method according to claim 1 wherein said tannic acid stain resistance improving agent is present in said solution in a concentration of 25 to 35 g/l.

6. Method according to claim 1 wherein the substrate and the tannic acid are brought into contact before the application of the dye.

7. Method according to claim 1 wherein the substrate and the tannic acid are brought into contact during the application of the dye.

8. Method according to claim 1 wherein the substrate and the tannic acid are brought into contact after the application of the dye.

9. Method according to claim 1 wherein the solution additionally contains a stabilizer in an amount sufficient to avoid oxidation of the substrate and the solution.

10. Method according to claim 1 wherein the stain resistant polyamide fiber-containing substrate thus recovered has been permanently dyed with acid dye.

11. Method according to claim 1 wherein the stain resistant polyamide fiber-containing substrate thus recovered has been permanently dyed with metallocomplex dye.

12. Method according to claim 1 wherein the stain resistant polyamide fiber-containing substrate thus recovered has been permanently dyed with basic dye.

13. Method according to claim 1 wherein the stain resistant polyamide fiber-containing substrate thus recovered has been permanently dyed with disperse dye.

14. Method according to claim 1 wherein the stain resistant polyamide fiber-containing substrate thus recovered is resistant to stains of at least members selected from the group consisting of coffee, tea, wine, fruit juice and ink.

15. A method of cleaning colored substrate comprising:

(a) providing substrate which has been treated according to steps (A) through (F2) of claim 1;

(b) applying stain to the dyed substrate after steps (A) through (F2) of claim 1; and (c) removing said stain from said substrate by application of water to the stain.

16. Method according to claim 15 wherein steps (b) and (c) are repeatedly performed.

17. Method according to claim 15 wherein said stain includes at least one member selected from the group consisting of coffee, tea, wine, fruit juice and ink.

18. Method for producing a stain resistant substrate with the aid of a stain resistance improving agent, said method comprising:

(A) providing a substrate comprising natural and/or synthetic fiber and containing polyamide fiber, (B) contacting said substrate with an acidic aqueous solution having a pH of up to about 6 and containing a tannic acid stain resistance improving agent in a concentration of 5 to 50 g/l, (C) bringing about such contact between said substrate and said at least one tannic acid during a dyeing process which includes one or more steps in which the substrate is given its colored and finished characteristics, (D) in said dyeing process, permanently dyeing said substrate by application to the substrate of at least one dye selected from the group consisting of acid dye, metallocomplex dye, basic dye and disperse dye, the application of dye to the substrate taking place or having taken place at a temperature up to about 90° C., (E) drying the substrate with said tannic acid stain resistance improving agent thereon, and (F) recovering a dried, permanently dyed polyamide fiber-containing substrate wherein (1) the tannic acid stain resistance improving agent consists of at least one tannic acid, and (2) the polyamide fiber-containing substrate thus recovered is resistant to stains caused by any of the members of the group consisting of anionic dye, cationic dye, disperse dye and metallocomplex dye and also by oxidative bleaching agent.

* * * * *